US008291793B2

(12) United States Patent
Wang

(10) Patent No.: US 8,291,793 B2
(45) Date of Patent: Oct. 23, 2012

(54) WRENCH ASSEMBLED STRUCTURE

(76) Inventor: Yao Hung Wang, Taiping (TW)

( * ) Notice: Subject to any disclaimer, the term of this patent is extended or adjusted under 35 U.S.C. 154(b) by 403 days.

(21) Appl. No.: 12/623,523

(22) Filed: Jan. 27, 2010

(65) Prior Publication Data

US 2011/0179916 A1 Jul. 28, 2011

(51) Int. Cl.
*B25B 23/16* (2006.01)

(52) U.S. Cl. ..... 81/177.85; 81/177.1; 16/110.1

(58) Field of Classification Search ..... 81/177.85, 81/177.2, 125, 177.1; 16/110.1–114.1, 405–430
See application file for complete search history.

(56) References Cited

U.S. PATENT DOCUMENTS

| | | | | | |
|---|---|---|---|---|---|
| 956,197 | A * | 4/1910 | Semsmon | 81/177.85 |
| 994,804 | A * | 6/1911 | Wahlstrom | 279/24 |
| 1,256,216 | A * | 2/1918 | Fessler | 81/177.85 |
| 1,310,641 | A * | 7/1919 | Welch | 81/125.1 |
| 1,440,272 | A * | 12/1922 | Bratton | 81/62 |
| 1,523,022 | A * | 1/1925 | Larson | 81/124.6 |
| 1,676,370 | A * | 7/1928 | Victory | 81/73 |
| 1,936,352 | A * | 11/1933 | Dixon | 81/125.1 |
| 2,438,633 | A * | 3/1948 | Condor | 403/107 |
| 2,523,041 | A * | 9/1950 | McKenzie | 81/436 |
| 2,697,371 | A * | 12/1954 | Bowman | 81/125.1 |
| 2,715,347 | A * | 8/1955 | Johnson | 81/124.2 |
| 2,825,374 | A * | 3/1958 | Reid | 81/438 |
| 3,121,356 | A * | 2/1964 | Davis | 81/125.1 |
| 3,227,015 | A * | 1/1966 | Tremblay | 81/177.2 |
| 3,242,775 | A * | 3/1966 | Hinkle | 81/119 |
| 4,367,663 | A * | 1/1983 | Merics | 81/177.2 |
| 5,279,189 | A * | 1/1994 | Marino | 81/177.8 |
| 5,307,713 | A * | 5/1994 | White | 81/180.1 |
| 5,911,798 | A * | 6/1999 | Arnold | 81/177.2 |
| D442,041 | S * | 5/2001 | Chen | D8/28 |
| 6,691,595 | B2 * | 2/2004 | Hsien | 81/124.5 |
| 6,761,094 | B2 * | 7/2004 | Tobako | 81/177.2 |
| 6,840,143 | B1 * | 1/2005 | Lin | 81/438 |
| 6,865,971 | B2 * | 3/2005 | Ernesti | 81/124.3 |
| 7,137,323 | B1 * | 11/2006 | Hsieh | 81/467 |
| 7,204,175 | B2 * | 4/2007 | Hsieh | 81/177.2 |
| 7,261,016 | B2 * | 8/2007 | Miller | 81/28 |
| 7,261,022 | B1 * | 8/2007 | Hsieh | 81/177.75 |
| 7,322,264 | B2 * | 1/2008 | Hu | 81/177.2 |
| 7,905,163 | B1 * | 3/2011 | Chiang | 81/177.9 |

* cited by examiner

*Primary Examiner* — Monica S. Carter
*Assistant Examiner* — Melanie Alexander

(57) ABSTRACT

A wrench assembled structure comprises a wrench head including an inserting portion, and the inserting portion including a neck portion connected with a crank, the crank including a head end mounted on a top end thereof, a gap of the head end including a hexagonal recess disposed on a rear end thereof, and the recess including a U-shaped retaining side arranged on an upper section thereof; a handle including a shank inserted to a shaft member, having a groove formed on a top end of the shank, and having an inner wall which includes a resilient piece fixed therein, and including a ball and a locking peg retained therein, the shaft member including an engaging section and a chamfer section formed therein.

9 Claims, 14 Drawing Sheets

WRENCH ASSEMBLED STRUCTURE

BACKGROUND OF THE INVENTION

1. Field of the Invention

The present invention relates to a wrench assembled structure that when the gap of the head end is fitted to the workpiece, it engages with the workpiece quickly, and prevents the gap from disengagement from the workpiece during operating the wrench.

2. Description of the Prior Art

A conventional wrench assembled structure includes a handle with a groove disposed on one end thereof so that the head end is inserted therein, and the groove includes an inner wall having a ball retained in the inner wall to engage the handle and the wrench head together, and the wrench head includes a gap between two sides thereof, two distances from a central axis line of the wrench head to two sides of the gap are not equal.

However, such a conventional wrench assembled structure still has the following disadvantages:

1. When a user removes the head end, it is time consuming to disengage the wrench head from the handle because of the ball is embodied to the inner wall of the groove fixedly, and the ball is rubbed easily to decrease the tight engagement of the wrench head and the handle.

2. The handle is not extendable and retractable to limit operating flexibility, especially in a limited space or operating angle.

3. The gap of the wrench head is formed in an arc shape that can not engage with the workpiece tightly, hence the workpiece disengages from the wrench head easily.

The present invention has arisen to mitigate and/or obviate the afore-described disadvantages.

SUMMARY OF THE INVENTION

The primary object of the present invention is to provide a wrench assembled structure that when the gap of the head end is fitted to the workpiece, it engages with the workpiece quickly, and prevents the gap from disengagement from the workpiece during operating the wrench.

A further object of the present invention is to provide a wrench assembled structure that the wrench head is fitted to the workpiece quickly and the wrench is forced smoothly during operation.

Another object of the present invention is to provide a wrench assembled structure that the wrench head id replaced quickly and then engaged with the handle tightly, and the handle allows to be extended or retracted based on requirement.

A wrench assembled structure in accordance with a preferred embodiment of the present invention comprising:

a wrench head including an inserting portion, and the inserting portion including a neck portion connected with a crank, the crank including a head end mounted on a top end thereof, a gap of the head end including a hexagonal recess disposed on a rear end thereof, and the recess including a U-shaped retaining side arranged on an upper section thereof;

a handle including a shank inserted to a shaft member, having a groove formed on a top end of the shank, and having an inner wall which includes a resilient piece fixed therein, and including a ball and a locking peg retained therein, the shaft member including an engaging section and a chamfer section formed therein.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
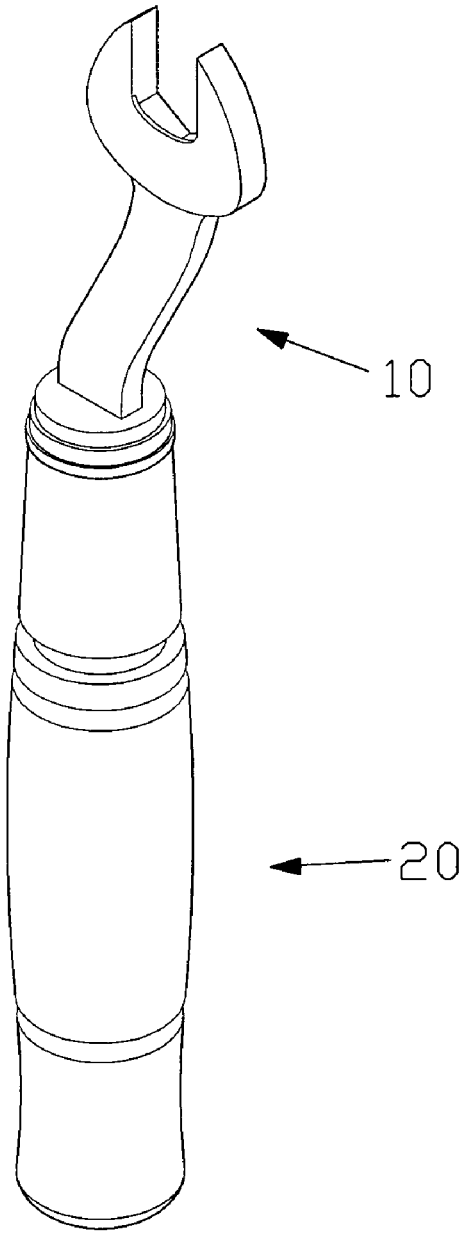
FIG. 1 is a perspective view showing the assembly of a wrench assembled structure according to a preferred embodiment of the present invention.
Figure 2:
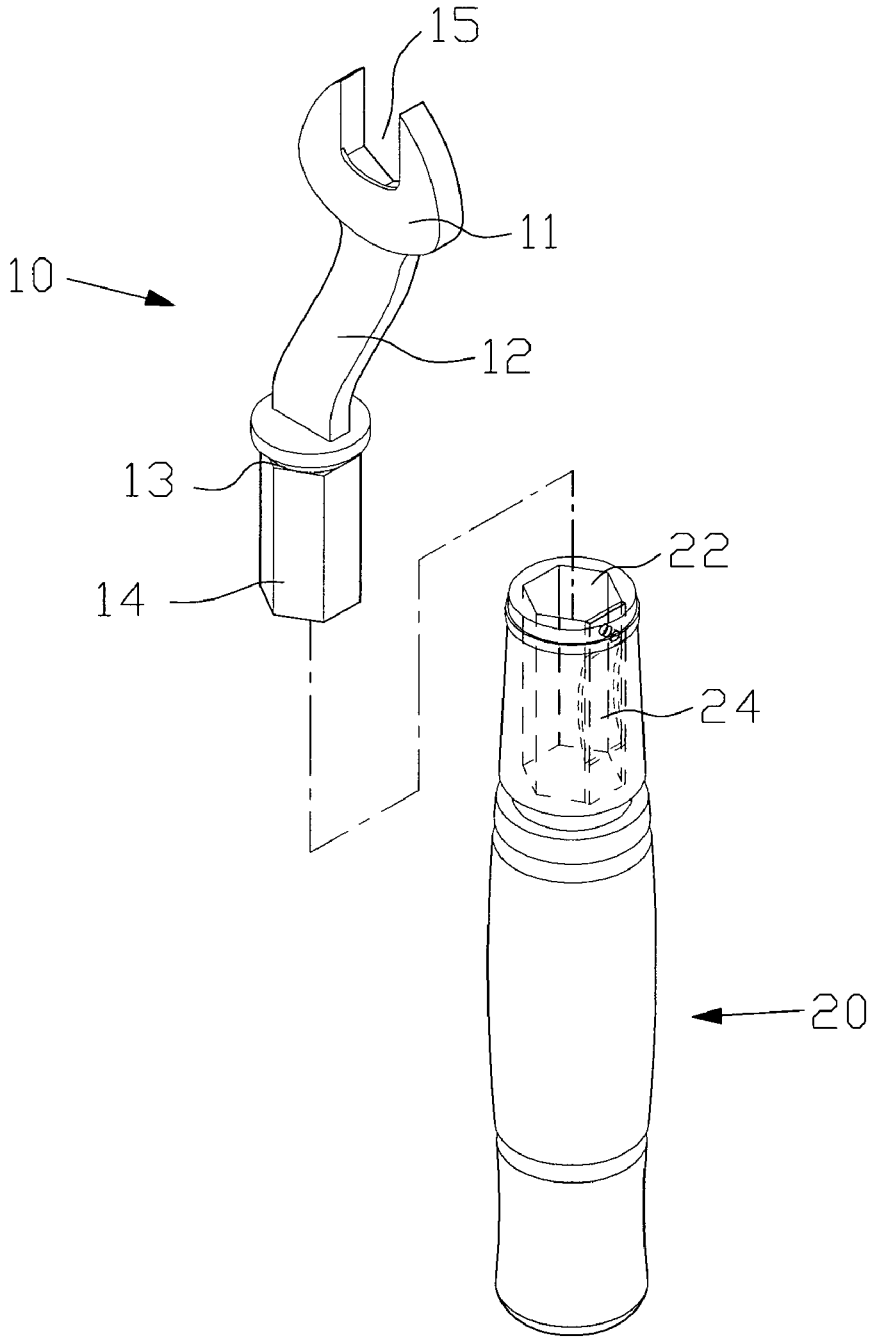
FIG. 2 is a perspective view showing the exploded components of the wrench assembled structure according to the preferred embodiment of the present invention.
Figure 3:
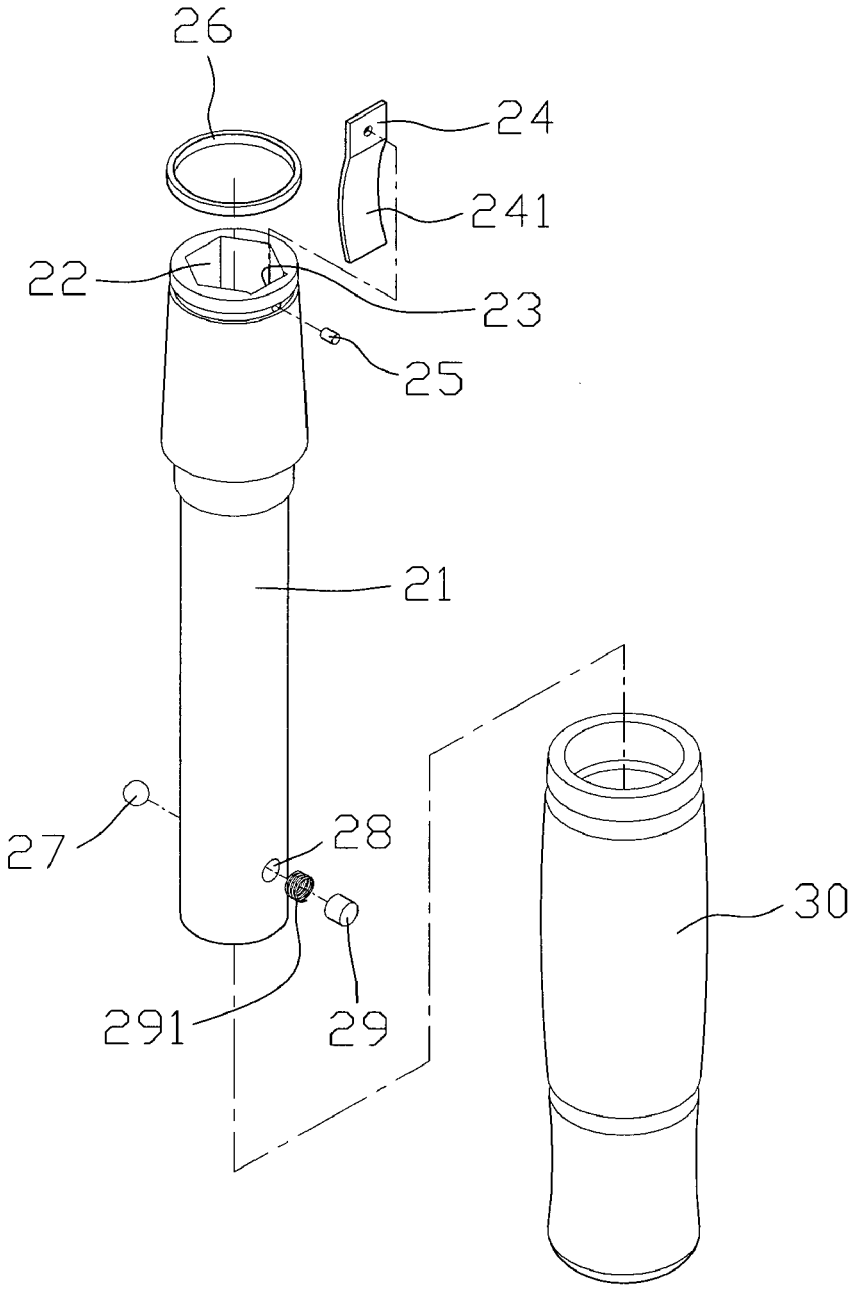
FIG. 3 is a perspective view showing the exploded components of a handle of the present invention.
Figure 10:
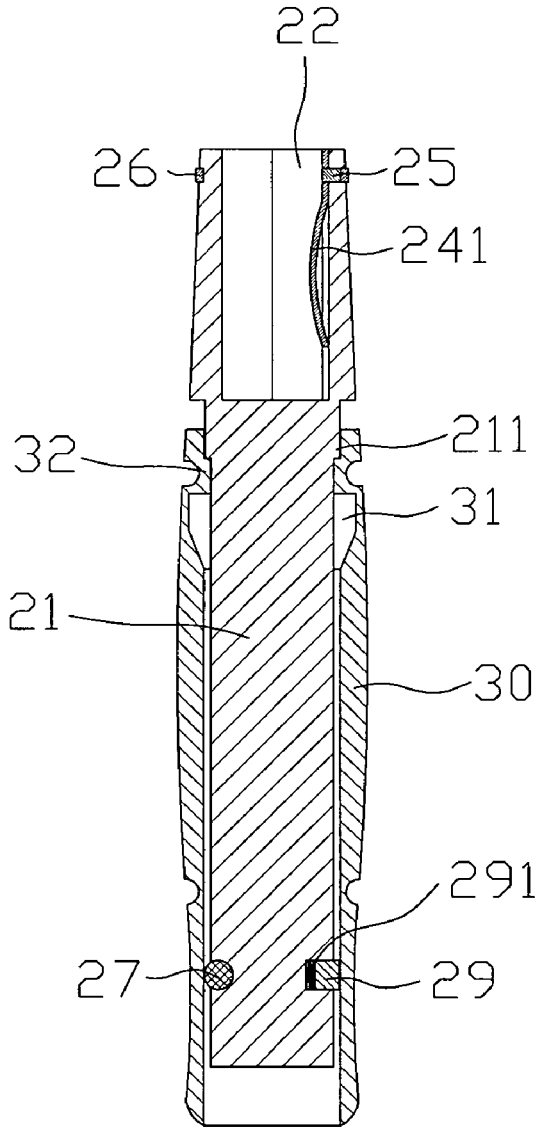
FIG. 10 is a cross sectional view showing the assembly of the handle of the present invention.

Referring to FIGS. 1-3, a wrench assembled structure in accordance with a preferred embodiment of the present invention comprises a wrench head 10 and a handle 20, wherein the wrench head 10 includes an inserting portion 14, and the inserting portion 14 includes a neck portion 13 covered by a color loop and connected with a crank 12, the crank 12 includes a head end 11 mounted on a top end thereof; the handle 20 includes a shank 21 inserted to a shaft member 30 and having a groove 22 formed on a top end of the shank 21, and having an inner wall 23 which includes a resilient piece 24 fixed therein by using a fixing element 25, the fixing piece 24 includes an abutting portion 241 secured on one end thereof, and the shank 21 includes a fitting ring 26 fitted on an outer rim of the top end thereof and includes a projection 211 (as shown in FIG. 10) extending outward therefrom, and includes a ball 27 retained in one side of an lower end thereof, and includes a slot 28 formed on another side of the lower side thereof in response to the ball 27 to receive a spring 291 and a locking peg 29.

Figure 4:
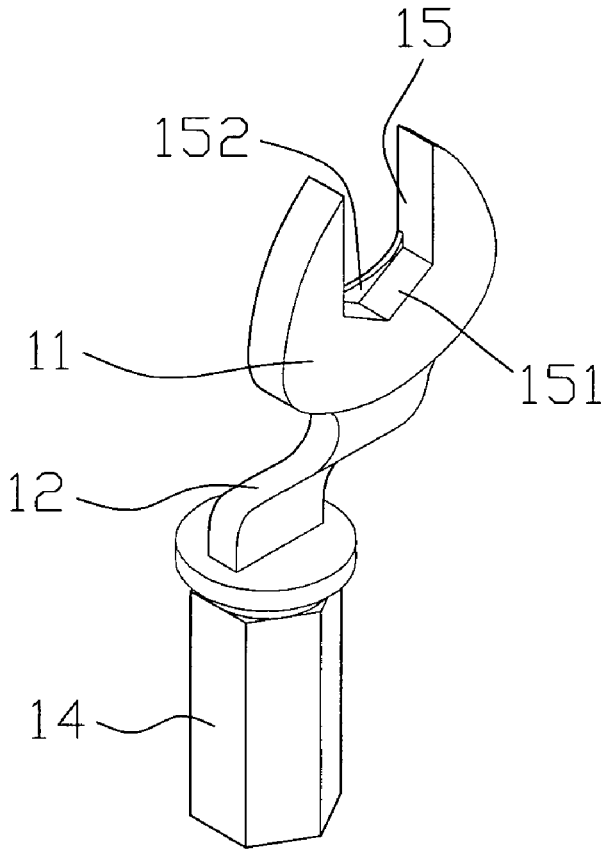
FIG. 4 is a perspective view showing the assembly of a wrench head of the present invention.
Figure 5:
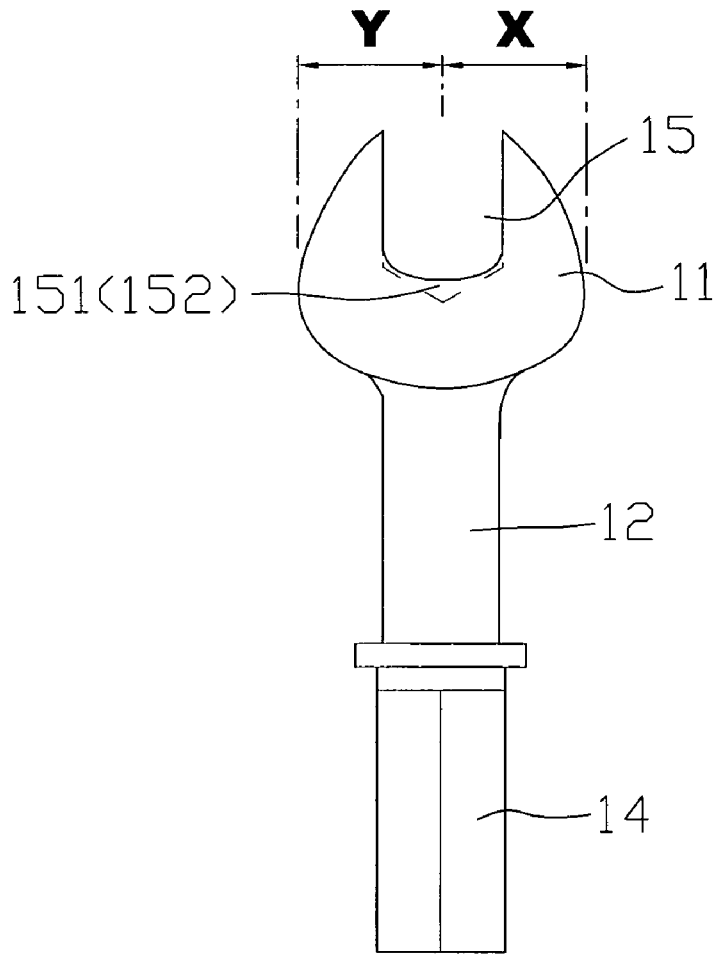
FIG. 5 is a plan view showing the assembly of the wrench head of the present invention.
Figure 6:
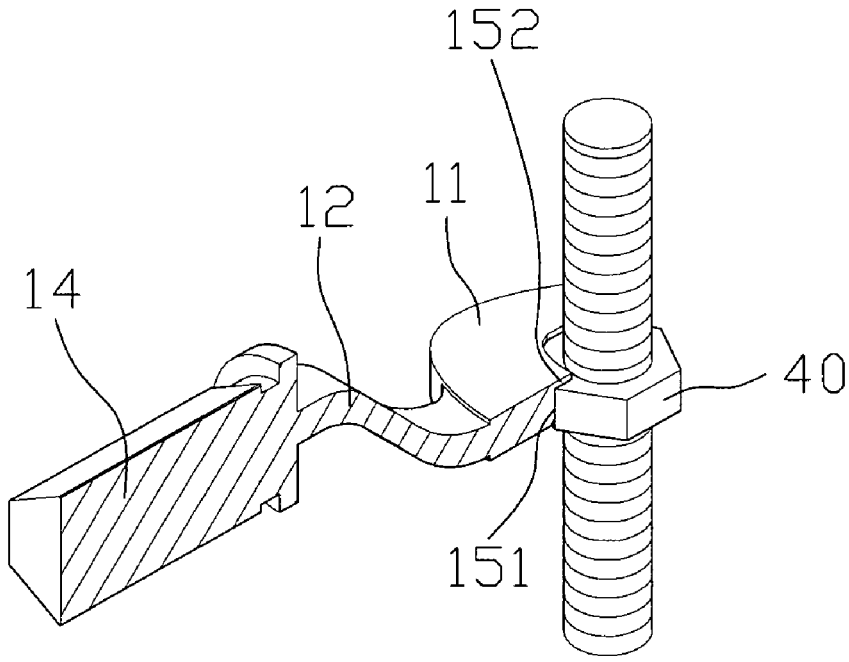
FIG. 6 is a partial perspective view showing the cross section of the wrench head of the present invention.
Figure 7:
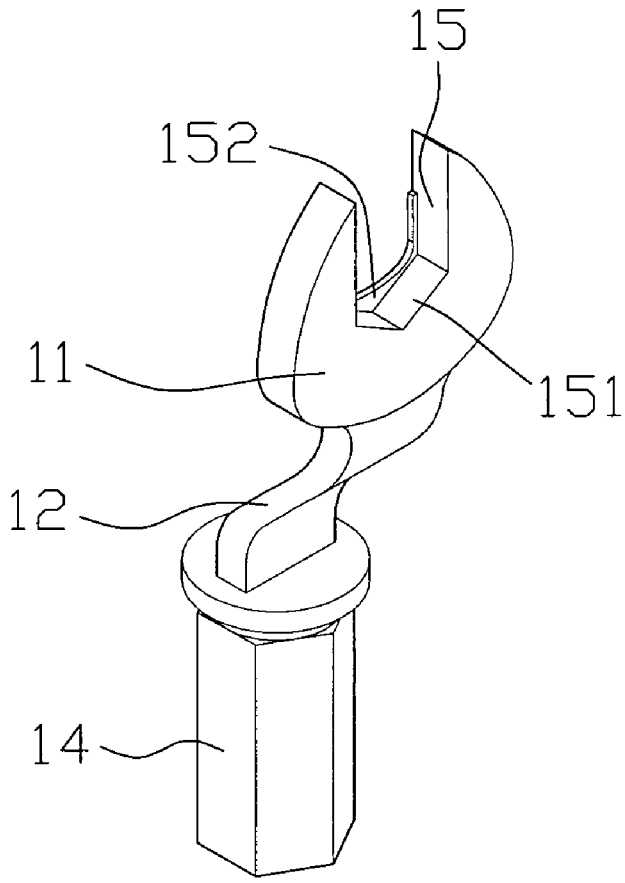
FIG. 7 is another perspective view showing the assembly of the wrench head of the present invention.
Figure 8:
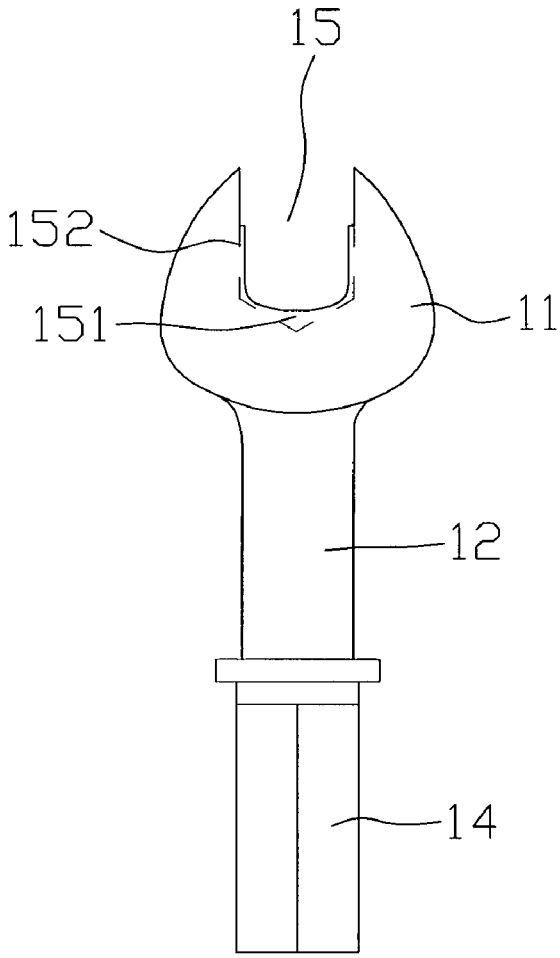
FIG. 8 is another plan view showing the assembly of the wrench head of the present invention.
Figure 9:
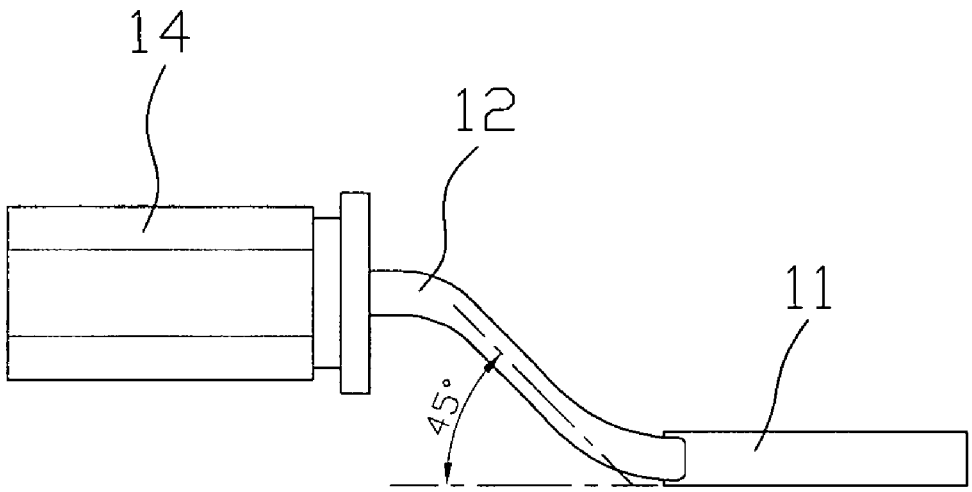
FIG. 9 is a plan view showing the angle of a crank of the present invention.

With reference to FIGS. 4-6, a gap 15 of the head end 11 includes a hexagonal recess 151 disposed on a rear end thereof, and the recess 151 includes a U-shaped retaining side 152 arranged on an upper section thereof so that during an operating process, the recess 151 engages an outer peripheral side of a workpiece 40, and the retaining side 152 abuts against an upper end of the workpiece 40 to enhance stability of the wrench head. In addition, distances X, Y from two sides of the gap 15 of the head end 11 to a central axis line are equal. Referring to FIGS. 7 and 8, a retaining side 152 extends a predetermined distance from a rear end of the gap 15 of the head end 11 to a front end thereof. As shown in FIG. 9, a crank 12 between the head end 11 and the inserting portion 14 is formed in an angle and height difference manner to obtain a preferred forcing operation.

Figure 11:
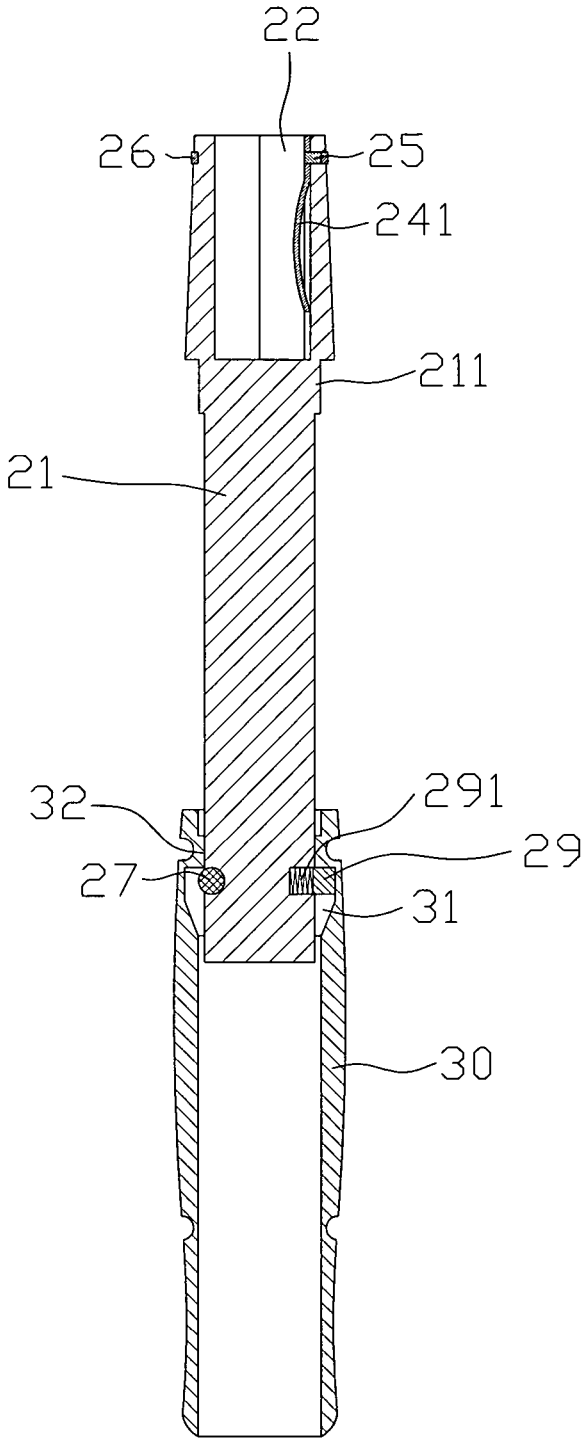
FIG. 11 is a cross sectional view showing the operation of the handle of the present invention.

As illustrated in FIGS. 10 and 11, when the handle 20 is in a retracting state, the projection 211 of the shank 21 is biased against an engaging section 32 of the shaft member 30, and the locking peg 29 of the shank 21 pushes against the slot 28. When the shank 21 is pulled outward, the locking peg 29 extends outward to be retained on a chamfer section 31, generating secure positioning effect. Also, the ball 27 spaces the shank 21 and the shaft member 30 apart to prevent the shank 21 from being rubbed.

Figure 12:
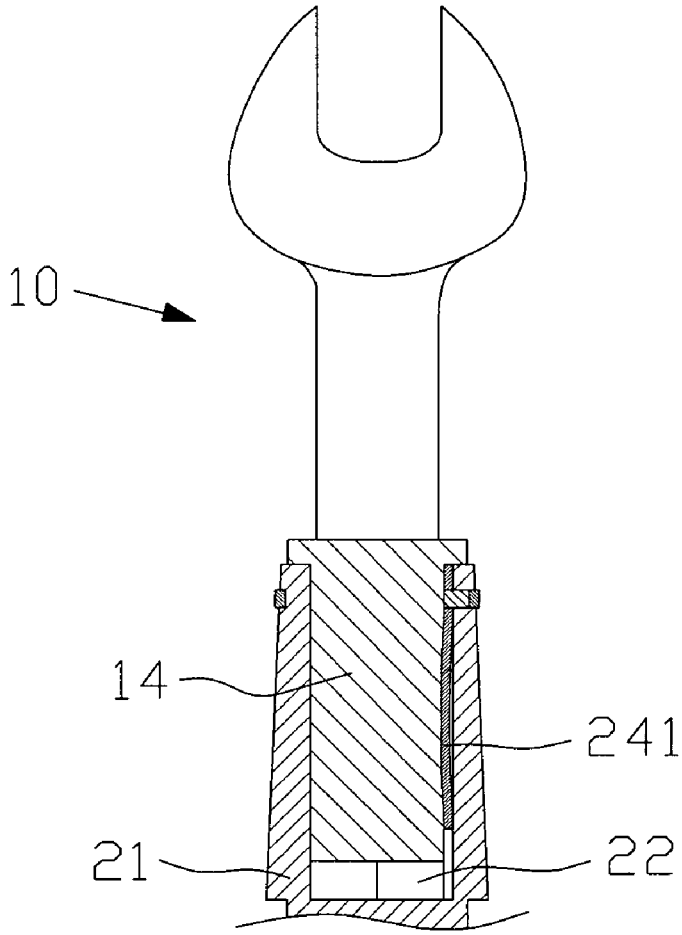
FIG. 12 is another cross sectional view showing the assembly of the wrench assembled structure according to the preferred embodiment of the present invention.
Figure 13:
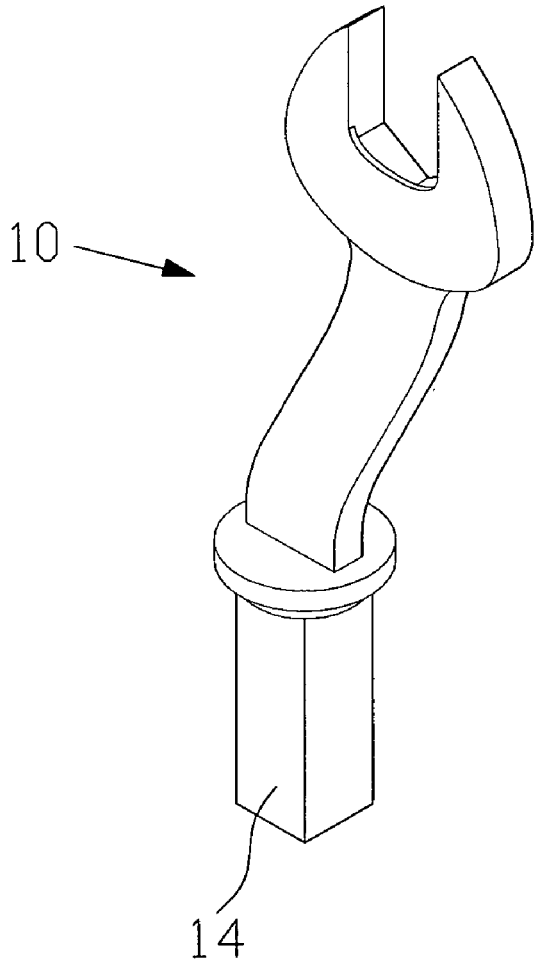
FIG. 13 is a perspective view showing the assembly of another wrench head of the present invention.
Figure 14:
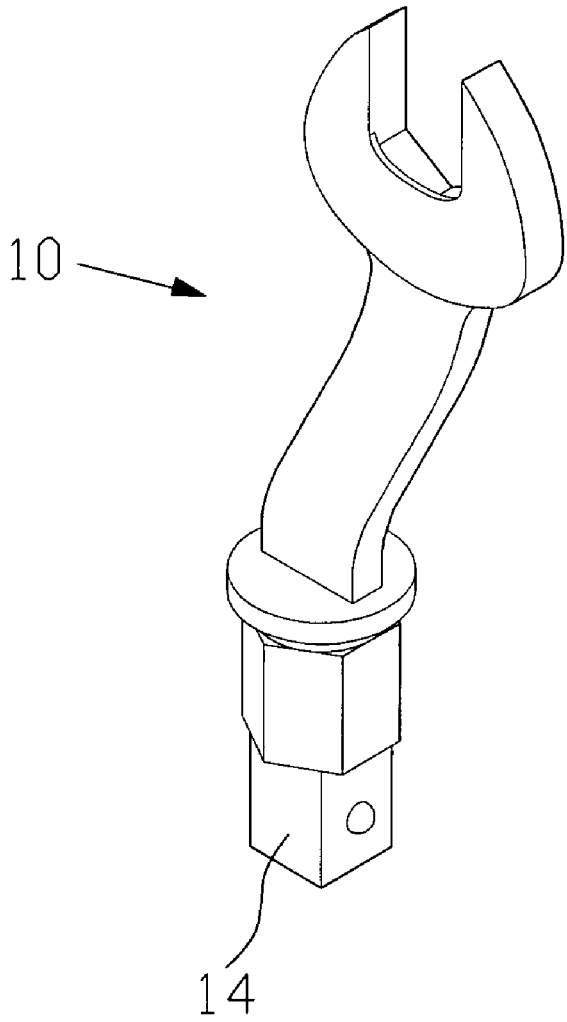
FIG. 14 is a perspective view showing the assembly of another wrench head of the present invention.

With reference to FIGS. 12-14, when the wrench head 10 is connected with the handle 20, the inserting portion 14 is inserted to the groove 22 so that the abutting portion 241 of the resilient piece 24 is compressed outward to abut against an outer side of the inserting portion 14, thereby positioning the wrench head 10, and the inserting portion 14 of the wrench head 10 allows to be formed in a quadrangle or hexagon shape.

While we have shown and described various embodiments in accordance with the present invention, it is clear to those skilled in the art that further embodiments may be made without departing from the scope of the present invention.

What is claimed is:

1. A wrench assembled structure comprising:

a wrench head including an inserting portion, and the inserting portion including a neck portion connected with a crank, the crank including a head end mounted on a top end thereof, a gap of the head end including a hexagonal recess disposed on a rear end thereof, and the recess including a U-shaped retaining side arranged on an upper section thereof;

a handle including a shank inserted to a shaft member; wherein the shank includes a groove formed on a top end thereof, the groove has an inner wall on which a resilient piece is fixed by using a fixing element, the fixing piece has an abutting portion secured on one end thereof, the shank also includes a fitting ring fitted on an outer rim of the top end thereof, a ball retained in one side of an lower end thereof, and a slot formed on another side of the lower side thereof to correspond to the ball and to receive a spring and a locking peg which is biased by the spring;

the shaft member includes an engaging section and a chamfer section on which the locking peg is retained.

2. The wrench assembled structure as claimed in claim 1, wherein the crank between the head end and the inserting portion is formed in an angle and height difference manner to obtain a preferred forcing operation.

3. The wrench assembled structure as claimed in claim 1, wherein distances from two sides of the gap of the head end to a central axis line are equal.

4. The wrench assembled structure as claimed in claim 1, wherein the retaining side extends a predetermined distance from a rear end of the gap of the head end toward a front end thereof.

5. The wrench assembled structure as claimed in claim 1, wherein the inserting portion is inserted to the groove, the abutting portion of the resilient piece is compressed outward to abut against an outer side of the inserting portion.

6. The wrench assembled structure as claimed in claim 1, wherein when the shank retracts into the shaft member, the projection of the shank is biased against the engaging section of the shaft member.

7. The wrench assembled structure as claimed in claim 1, wherein when the shank is pulled outward, the locking peg extends outward to be retained on the chamfer section.

8. The wrench assembled structure as claimed in claim 1, wherein the inserting portion of the wrench head is formed in a quadrangle shape.

9. The wrench assembled structure as claimed in claim 1, wherein the inserting portion of the wrench head is formed in a hexagon shape.

* * * * *